United States Patent [19]

Lang

[11] Patent Number: 4,543,809

[45] Date of Patent: Oct. 1, 1985

[54] APPARATUS FOR BENDING THIN-WALLED PIPES

[76] Inventor: Thomas P. Lang, Erbacher Strasse 45, 6120 Michelstadt, DE, Fed. Rep. of Germany

[21] Appl. No.: 510,391

[22] Filed: Jun. 30, 1983

[30] Foreign Application Priority Data

Jul. 3, 1982 [DE] Fed. Rep. of Germany ... 8219048[U]

[51] Int. Cl.[4] ..... B21D 7/04; B21D 9/05

[52] U.S. Cl. ..... 72/150

[58] Field of Search ..... 72/133, 150, 216, 217, 72/310, 319, 321, 369, 370

[56] References Cited

U.S. PATENT DOCUMENTS

| | | | |
|---|---|---|---|
| 304,639 | 9/1884 | Grimmett et al. | 72/150 X |
| 2,873,786 | 2/1959 | Fuchs | 72/150 |
| 2,936,019 | 5/1960 | Miller | 72/133 |
| 2,962,077 | 11/1960 | Condiff | 72/150 X |
| 3,650,136 | 3/1972 | Sindelar | 72/150 |
| 4,085,608 | 4/1978 | Franks et al. | 72/150 X |
| 4,331,015 | 5/1982 | Benteler et al. | 72/150 X |
| 4,331,016 | 5/1982 | Benteler et al. | 72/150 X |

FOREIGN PATENT DOCUMENTS

| | | | |
|---|---|---|---|
| 620631 | 10/1935 | Fed. Rep. of Germany | 72/150 |
| 268289 | 10/1929 | Italy | 72/217 |

*Primary Examiner*—E. Michael Combs

*Attorney, Agent, or Firm*—Michael J. Striker

[57] ABSTRACT

Thin walled pipes, as for example pressure gauge springs are bent by inserting a flexible mandrel in to the pipe and to forward the pipe simultaneously with the mandrel over a forming member until a sufficient length of the pipe is provided for the bending step. The mandrel is then forwarded relative to the pipe to project therefrom and both parts are bent around the forming member. Then, the mandrel is retracted and the pipe arc is separated.

7 Claims, 10 Drawing Figures

APPARATUS FOR BENDING THIN-WALLED PIPES

BACKGROUND OF THE INVENTION

The invention relates to a method and apparatus for bending thin-walled pipes, in particular pressure gauge springs.

Pressure-gauge springs must be produced of very thin-walled pipe material so that they can sufficiently deform under the interior pressure to be measured. In general, such pressure gauge springs must be bent in an arc of approximately 270°.

It is known to use a mandrel bending apparatus in which the pipe to be bent is removed from the end of the mandrel and is simultaneously bent in such a manner that the pipe moves with the rotating forming member. This principle seems to be sound, as it allows to manufacture successively a number of pipe parts from a single elongated pipe piece in a substantially automatic cycle and to subsequently separate each manufactured pipe arc.

Nevertheless, such a mandrel bending apparatus cannot be used when the manufacture of thin-walled pipe material is concerned. Pipes having a wall thickness under 0.2 mm cannot be produced in such a manner because of occurring cracks and/or flexures.

Therefore, it is necessary to manufacture the extremely thin-walled pipe individually and manually in order to render their use appropriate for pressure gauge springs. In this manner, a flexible mandrel is inserted into the pipe which usually has a flat cross section and is then bent manually around the forming member. Thereafter the mandrel is removed from the bent pipe. It is obvious that this bending method is extremely cumbersome and requires a considerable time.

SUMMARY OF THE INVENTION

It is therefore the object of the present invention to avoid the prior art disadvantages.

In particular, it is an object of the present invention to provide a method and apparatus for bending thin-walled pipes wherein the manufactured pipe arc has unobjectionable properties.

Yet another object of the present invention is to provide a method and apparatus which allow the manufacture of extremely thin-walled and possibly flat pipe arcs in a substantially automatic working cycle.

A concomitant object of the present invention is to provide an apparatus for bending thin-walled pipes which is simple in construction, reliable in operation and nevertheless inexpensive to manufacture.

In keeping with these objects and with others which will become apparent hereinafter, one feature of the present invention resides in a method for bending a thin-walled pipe, which comprises inserting a bendable mandrel within the pipe, forwarding the pipe together with the mandrel to a forming member, moving the mandrel relative to the pipe so that a portion of the mandrel projects beyond the pipe, bending the pipe and the mandrel around the forming member to form a bent pipe piece, retracting the mandrel relative to the pipe out of the bent pipe piece, and separating the bent pipe piece.

The use of a mandrel which is movable not only simultaneously with the pipe but also relative thereto renders it possible to produce successively a number of pipe arcs from a pipe in which the mandrel is inserted and to separate each pipe arc from the elongated pipe. In order to prevent damage of the forward pipe portion during the bending step, the mandrel which has a flexible forward portion must project beyond the forward portion of the pipe. Consequently, the mandrel has to be moved relative to the pipe. After bending of the pipe has taken place and prior to the separation of the pipe arc, the mandrel must also be moved relative to the pipe and thus is retracted to such an extent that no damage can occur to the mandrel when the pipe arc is separated. After separation has taken place, the mandrel is again moved relative to the pipe in order to project beyond the forward end of the pipe.

Through the provision of such a method, there is no danger that cracks or flexures may occur because the mandrel fills the pipe during the bending step and because the pipe is bent around the forming member which is stationarily provided so that no traction can be exerted on the thin-walled pipe.

According to another feature of the invention, an apparatus for bending a thin-walled pipe comprises a support frame having an axis, a mandrel carriage movable with respect to the axis of the support frame, a bendable mandrel cooperating with the mandrel carriage so that upon movement of the mandrel carriage the mandrel is simultaneously co-moved, means for clamping the pipe, and cooperating with the mandrel carriage in such a way that the mandrel is selectively movable simultaneously with and relative to the pipe, and means for bending the pipe and the mandrel so as to provide a bent pipe piece and for separating the bent piece once the mandrel is retracted.

Since only the forward portion of the mandrel projects into the pipe piece to be bent, according to a further feature of the invention it is sufficient to provide the forward portion of the mandrel in a flexible manner while the remaining part thereof can be developed as a rod. When it is required to forward a pipe portion of a certain length which is to be bent, the mandrel is moved simultaneously with the pipe. The provision of a relative movement between the mandrel and the pipe is required in order to have the flexible portion of the mandrel projecting from the forward end of the pipe, which is necessary for the bending step, and to retract the mandrel prior to the separation in order to avoid that the mandrel be damaged, that is separated with the manufactured pipe piece.

According to another feature of the invention, the clamping means includes two clamping devices, wherein the first one of the clamping devices is movable with respect to the axis of the support frame and has a stationary clamping jaw which cooperates with a clamping jaw movable in a direction relative to the stationary clamping jaw so as to allow clamping and releasing of the pipe. The other of the clamping devices is stationary but otherwise provided in the same manner as the first clamping device and consequently has a stationary clamping jaw cooperating with a clamping jaw movable in a direction relative to the stationary clamping jaw so as to allow clamping and releasing of the pipe.

The bending means according to the invention includes a stationary forming member which cooperates with a bending jaw movable around the forming member so that the pipe portion which is to be bent and located between the forming member and the bending jaw is bent by the rotational movement of the bending jaw with respect to the forming member.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
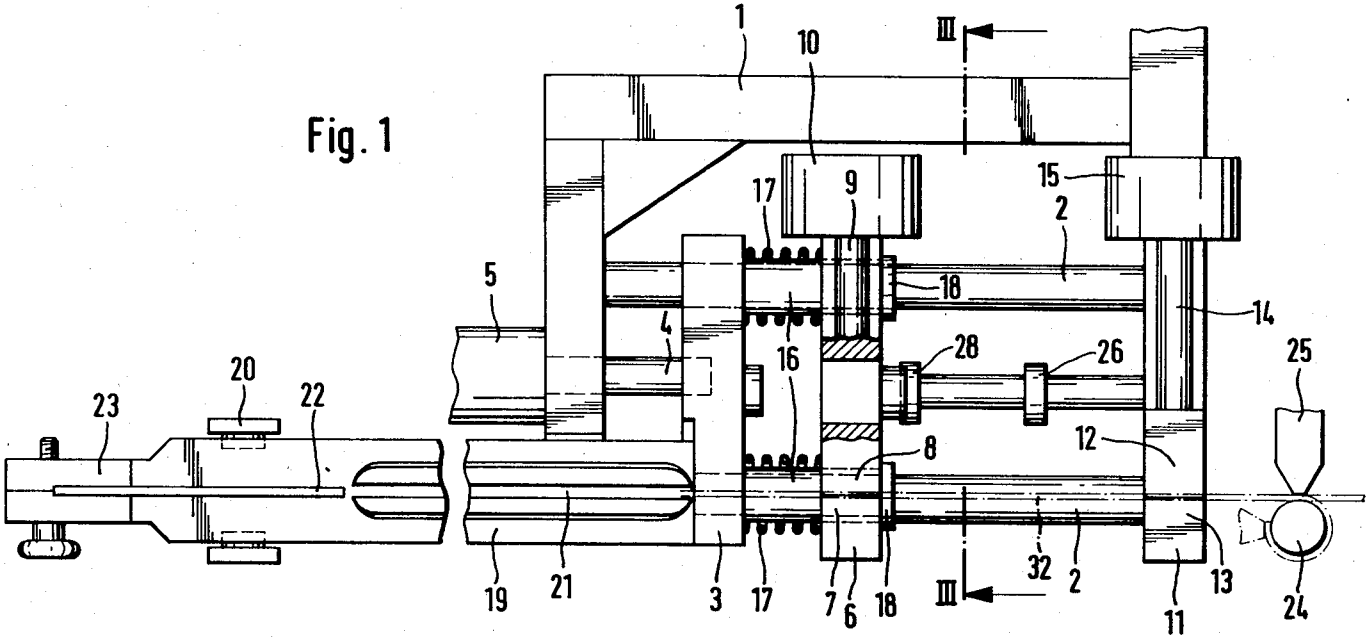
FIG. 1 illustrates schematically the relevant parts of an apparatus for bending thin-walled pipes in a top view.
Figure 2:
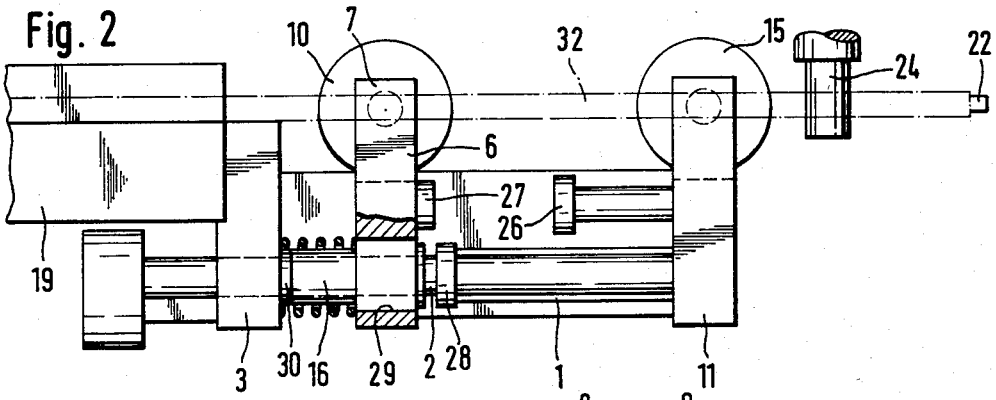
FIG. 2 is a side view of the apparatus according to FIG. 1.
Figure 3:
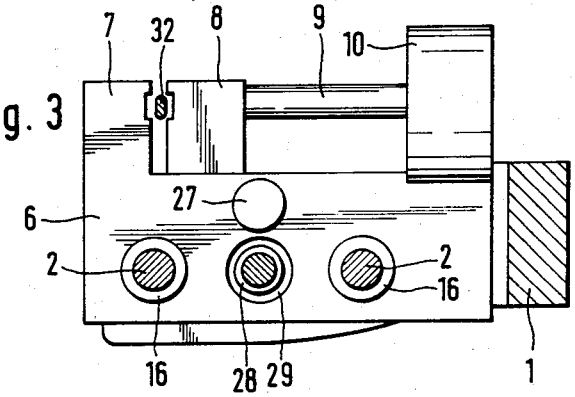
FIG. 3 is a cross-sectional view along the line III—III according to FIG. 1.

Referring firstly to the FIGS. 1–3 in which the apparatus for bending of thin-walled pipes, in particular pressure gauge springs, is illustrated, there is shown a support frame 1 which has two adjacent circular guides parallel to each other. Movable along the guides 2 is a mandrel carriage 3 which is connected to a piston rod 4 of a pressure medium cylinder 5.

Located parallel to the mandrel carriage 3 is a first clamping device 6 which is also movably connected to the circular guides 2. The clamping device 6 has a stationary clamping jaw 7 and a clamping jaw 8 which is movable relative to the clamping jaw 7, so that a pipe 32 shows in dash-dotted lines can be clamped upon relative movement of the clamping jaw 8 with respect to the stationary clamping jaw 7. The movement of the clamping jaw 8 is provided by a cylinder piston arrangement including a piston rod 9 which connects the clamping jaw 8 to a pressure medium cylinder 10 associated to the clamping device 6.

As can be seen from FIG. 1, the apparatus includes a second clamping device 11, which is stationary and fixed to the support frame (not shown) but otherwise is provided in the same manner as the clamping device 6 and thus comprises a stationary clamping jaw 13 and a clamping jaw 12 movable relative thereto via a piston rod 14 of a pressure medium cylinder 15.

The first clamping device 6 is movably connected on two bushings 16 which are connected with the mandrel carriage 3 and is pressed against a rod stop 18 located at the end of the bushing 16 by pressure springs 17. Consequently, a forward movement of the mandrel carriage 3 provides via the springs 17 a forward movement of the clamping device 6.

The mandrel carriage 3 is fixedly connected with an elongated pipe supporting rail 19 which consists of a square pipe and is slidably supported in one or several (not shown) supports by guide rollers 20. The pipe support rail 19 has a top surface provided with a longitudinally extending groove 21 which receives a mandrel 22. The rear end portion of the mandrel 22 is connected to the support rail 19 via a clamping connection 23.

As can be further seen from FIG. 1, a forming member 24 is arranged adjacent to the stationary clamping device 12. Cooperating with the forming member 24 is a rotatable bending jaw 25 which rotates about the vertical axis of the forming member 24 and provides the bending of the respective pipe piece as will be described hereinbelow.

The forward movement of the clamping device 6 is limited by a stop member 26 which is connected to the support frame 1 and cooperates with a counterstop member 27 provided at the clamping device 6. A further stationary stop member 28 is provided for limiting the forward movement of the mandrel carriage 3 and thus cooperates with a counterstop member 30 located on the mandrel carriage 3. In order to prevent interference of the stationary stop member 28 with the clamping device 6, the clamping device is provided with a through hole 29 so that the stop member 28 can pass through the through hole 29 upon forward movement of the clamping device 6. The distance of the stop members 26, 28 to the mandrel carriage 3 and clamping device 6, respectively, is chosen in such a manner that upon forward movement of the mandrel carriage 3, the clamping device 6 is firstly contacting the respective stop member 26 and only subsequently upon a further forward movement of the mandrel carriage 3, an engagement of the counterstop member 30 with the stop member 28 is provided.

Figure 4:
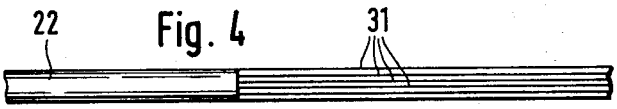
FIG. 4 is a top view of the forward portion of a mandrel according to the invention on an enlarged scale; and FIGS. *5a–5f* are a schematic illustration of subsequent steps of the method according to the invention provided for bending thin-walled pipes.

As shown in FIG. 4, the mandrel 22 has a forward portion provided with a set of adjacent spring steel strips 31 so as to be flexible. Through this provision, the mandrel can be bent simultaneously with the pipe piece.

Turning now to FIG. 5, which illustrates in simplified manner the individual steps during the bending of a respective portion of the pipe:

FIG. *5a* shows the first step of the cycle wherein the clamping device 6 is in engagement with the pipe 32 while the second clamping device 12 is disengaged. The mandrel carriage 3 now moves forwardly so that also the first clamping device 6 carries out a forward movement. As the clamping device 6 engages the pipe 32, a simultaneous forward movement thereof is obtained. In addition, the mandrel 22, which is connected to the mandrel carriage 3 via the pipe support rail 19, is taken along. When the first clamping device 6 abuts against the stop member 26 and thus cannot perform any forward movement, the pipe 32 is forwarded over the forming member 24 to such an extent that the respective length is sufficient to provide a pipe arc (FIG. *5b*). The second clamping device 12 is still in an open position.

The mandrel carriage 3 is then forwarded until its counterstop member 30 is abutting the associated stop member 28. During this forward movement, the mandrel carriage 3 is moving the mandrel 22 relative to the pipe 32 as the clamping device 6 which engages the stop 26 cannot carry out any further forward clamping device 12 is still disengaged from the pipe 32. When the forward movement of the mandrel carriage 3 is stopped, the mandrel 22 projects sufficiently from the forward end of the pipe (FIG. *5c*). In this position, the bending jaw 25 rotates about the stationary forming member 24, so that the pipe 32 simultaneously with the surrounded flexible forward portion of the mandrel 22 is bent to a pipe arc (FIG. *5d*). For simplicity, FIG. 5 shows only a relatively short pipe arc, but it is to be noted that the bending of a thin-walled pipe, for example during the manufacture of pressure-gauge springs, is usually approximately 270°. As can be further seen from FIG. 5*d*, during the bending step, the stationary clamping device 12 engages the pipe.

Figure 5A:
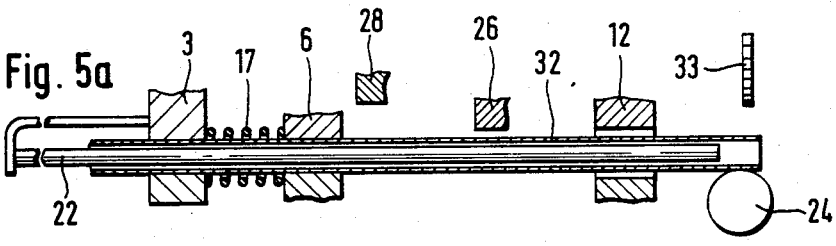
Figure 5B:
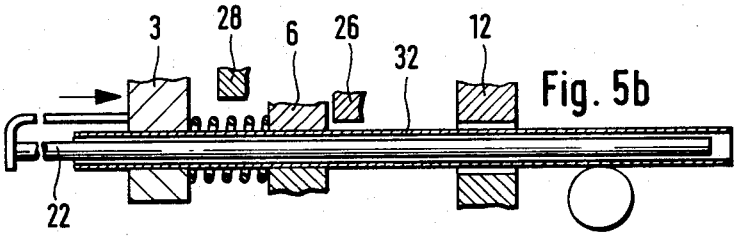
Figure 5C:
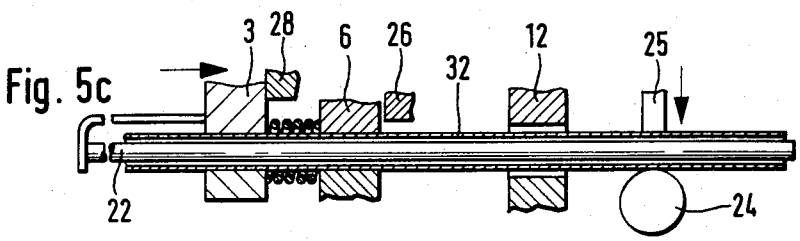
Figure 5D:
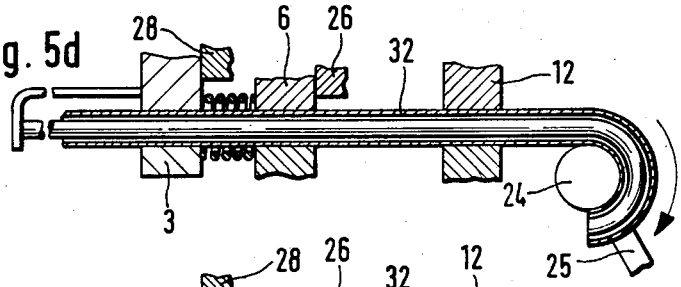
Figure 5E:
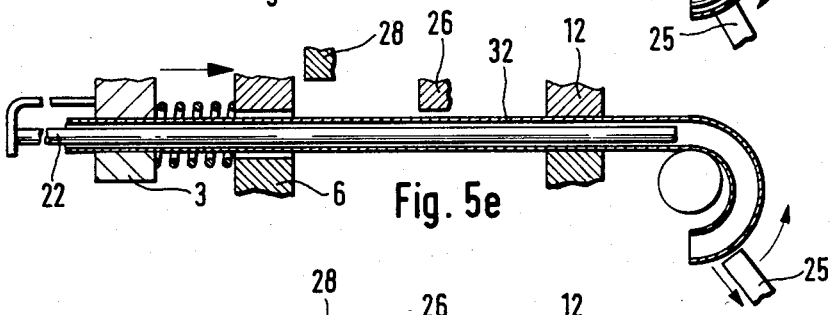
Figure 5F:
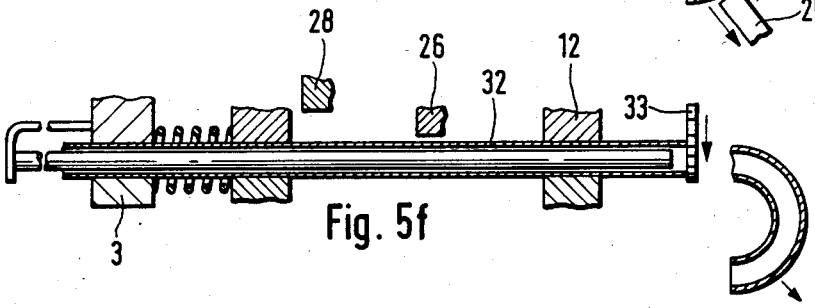

After termination of the bending step, the bending jaw 25 returns to its initial position thereby rendering possible a springy action of the pipe arc (FIG. 5*e*). Then, the mandrel carriage 3 retracts to its initial position after the first clamping device 6 has disengaged from the pipe 32. Since the second clamping device 12 is still clamping the pipe 32, only the mandrel 22 is retracted, and thus performs a relative movement to the pipe 32. The backward movement of the mandrel carriage 3 is sufficient to retract the mandrel 22 behind the location on which a separating device is acting, for example a circular saw 33 for separating the respective pipe arc. For the sake of simplicity, the circular saw 33 is not shown in FIGS. 1–3. After separation of the pipe arc (FIG. 5*f*), all parts are again in the initial position according to FIG. 5*a*.

The length of the mandrel 22 is selected in such a manner that a pipe 32 can be used for manufacturing a great number of pipe arcs. As explained especially with respect to FIG. 5, these pipe arcs are successively bent and separated in an automatic working cycle until the entire pipe 32 is processed. Thereafter, a new pipe 32 is provided whereby the mandrel 22 is inserted therein.

In the described embodiment, the mandrel 22 is provided with several flexible spring steel strips 31 at its forward end portion. However, it is certainly within the scope of the invention to provide the mandrel 22 completely flexible or to provide the flexible forward portion in a different manner, for example of flexible plastic material.

It will be understood that each of the elements described above, or two or more together, may also find a useful application in other types of methods and apparatus for bending thin-walled pipes differing from the types described above.

While the invention has been illustrated and described as embodied in a method and apparatus for bending a thin-walled pipe, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for bending a thin-walled pipe, comprising a support frame having an axis; a mandrel carriage movable with respect to the axis of the support frame; a bending mandrel cooperating with the carriage so that upon movement of the mandrel carriage the mandrel is simultaneously co-moved; means for clamping the pipe and cooperating with the mandrel carriage in such a way that the mandrel is selectively movable simultaneously with and relative to the pipe; means for bending the pipe and the mandrel so as to provide a bent pipe piece and for separating the bent pipe piece once the mandrel is retracted; the clamping means including two clamping devices, the first one of the clamping devices being movable with respect to the axis of the support frame and having a stationary clamping jaw and a cooperating clamping jaw movable in direction relative to the stationary clamping jaw so as to allow clamping and releasing of the pipe; the second one of the clamping devices being stationary and having a fixed clamping jaw and a cooperating clamping jaw movable relative to the stationary clamping jaw so as to allow clamping and releasing of the pipe; and further comprising at least one spring having one end abutting the first clamping device, and another end resting against the mandrel carriage so as to provide the cooperating movement between the first clamping device and the mandrel carriage.

2. Apparatus as defined in claim 1, wherein the mandrel carriage is connected with a longitudinally extending pipe supporting rail which is movable in direction of the axis of the support frame, the support rail being fixedly connected with the rear end portion of the mandrel.

3. Apparatus for bending a thin-walled pipe, comprising a support frame having an axis; a mandrel carriage movable with respect to the axis of the support frame; a bending mandrel cooperating with the carriage so that upon movement of the mandrel carriage the mandrel is simultaneously co-moved; means for clamping the pipe and cooperating with the mandrel carriage in such a way that the mandrel is selectively movable simultaneously with and relative to the pipe; means for bending the pipe and the mandrel so as to provide a bent pipe piece and for separating the bent pipe piece once the mandrel is retracted; the clamping means including two clamping devices; the first one of the clamping device being movable with respect to the axis of the support frame and having a stationary clamping jaw and a cooperating clamping jaw movable in direction relative to the stationary clamping jaw so as to allow clamping and releasing of the pipe, and further comprising stop means including a first stop member cooperating with the mandrel carriage and a second stop member cooperating with the first clamping device, the stop means being respectively located in the moving direction of the mandrel carriage and the first clamping device so as to provide a stop for the forward movement of the mandrel carriage and for the first clamping device.

4. Apparatus as defined in claim 3, wherein the mandrel carriage and the first clamping device abut successively the respective one of the stop members.

5. Apparatus as defined in claim 4, wherein the first clamping device abuts against the respective one of the stop members prior to the abutment of the mandrel carriage with the other of the stop members.

6. Apparatus as defined in claim 3, wherein the first clamping device is provided with a through hole in axial direction through which through hole the first stop member can pass upon forward movement of the first clamping device.

7. Apparatus for bending a thin-walled pipe, comprising a support frame having an axis; a mandrel carriage movable with respect to the axis of the support frame; a bending mandrel cooperating with the carriage so that upon movement of the mandrel carriage the mandrel is simultaneously co-moved; means for clamping the pipe and cooperating with the mandrel carriage in such a way that the mandrel is selectively movable simultaneously with and relative to the pipe; means for bending the pipe and the mandrel so as to provide a bent pipe piece and for separating the bent pipe piece once the mandrel is retracted; the clamping means including two clamping devices, the first one of the clamping devices being movable with respect to the axis of the support frame and having a stationary clamping jaw and a cooperating clamping jaw movable in direction relative to the stationary clamping jaw so as to allow clamping and releasing of the pipe, and further comprising at least one spring having one end abutting the first clamping device, and another end resting against the mandrel carriage so as to provide the cooperating movement between the first clamping device and the mandrel carriage.

* * * * *